US006866459B2

(12) United States Patent
Cobene et al.

(10) Patent No.: US 6,866,459 B2
(45) Date of Patent: Mar. 15, 2005

(54) SYSTEMS AND METHODS OF REGISTERING A COVER WITH RESPECT TO A TEXT BODY

(75) Inventors: Robert L. Cobene, Santa Clara, CA (US); Steven W. Trovinger, Los Altos, CA (US); Raymond G. Schuder, Menlo Park, CA (US); John P. Ertel, Portola Valley, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 34 days.

(21) Appl. No.: 09/793,466

(22) Filed: Feb. 26, 2001

(65) Prior Publication Data

US 2002/0119029 A1 Aug. 29, 2002

(51) Int. Cl.[7] ..... B42C 11/00

(52) U.S. Cl. ..... 412/4; 270/52.08; 270/58.08; 281/21.1; 412/1; 412/8; 412/9

(58) Field of Search ..... 412/1, 4, 6, 8, 412/9, 16, 19, 5, 33; 281/21.1, 15.1; 270/52.08, 57.08, 58.08

(56) References Cited

U.S. PATENT DOCUMENTS

| | | | | | |
|---|---|---|---|---|---|
| 4,184,218 | A | * | 1/1980 | Hawkes | 156/908 |
| 4,299,410 | A | | 11/1981 | Jukola | |
| 4,547,000 | A | * | 10/1985 | Sallinen | 281/23 |
| 4,906,156 | A | * | 3/1990 | Axelrod | 412/19 |
| 4,911,475 | A | | 3/1990 | Lerman | |
| 5,028,193 | A | | 7/1991 | Misicka | |
| 5,062,754 | A | * | 11/1991 | Bolin et al. | 412/4 |
| 5,108,244 | A | * | 4/1992 | Bellanca | 412/37 |
| 5,129,772 | A | | 7/1992 | Slautterback | |
| 5,152,654 | A | | 10/1992 | Luhman et al. | |
| 5,207,456 | A | | 5/1993 | Danhoff | |
| 5,261,769 | A | | 11/1993 | Leclerc | |
| 5,271,794 | A | | 12/1993 | Jarrell et al. | |
| 5,316,424 | A | | 5/1994 | Luhman et al. | |
| 5,346,350 | A | | 9/1994 | Luhman et al. | |
| 5,437,476 | A | | 8/1995 | Hutchinson | |
| 5,536,044 | A | | 7/1996 | Luhman et al. | |
| 5,605,425 | A | | 2/1997 | Schaefer | |
| 5,632,587 | A | | 5/1997 | Coyette | |
| 5,662,448 | A | * | 9/1997 | Graushar et al. | 412/19 |
| 5,779,423 | A | | 7/1998 | Bermingham | |
| 5,871,323 | A | * | 2/1999 | Clark | 412/19 |
| 5,975,823 | A | * | 11/1999 | Schlough | 412/8 |
| 6,142,721 | A | * | 11/2000 | Marsh | 281/21.1 |
| 6,193,458 | B1 | * | 2/2001 | Marsh | 412/1 |
| 6,572,318 | B2 | * | 6/2003 | Cobene et al. | 412/11 |
| 2002/0019029 | A1 | * | 2/2002 | Barnes et al. | 435/69.1 |
| 2003/0086773 | A1 | * | 5/2003 | Lawton | 412/1 |

FOREIGN PATENT DOCUMENTS

| | | |
|---|---|---|
| JP | 6048065 | 2/1994 |
| JP | 8324153 | 12/1996 |
| JP | 9220877 | 8/1997 |
| JP | 10016431 | 1/1998 |
| JP | 11170727 | 6/1999 |
| JP | 11245538 | 9/1999 |
| WO | WO99/38707 | 8/1999 |

* cited by examiner

*Primary Examiner*—Monica S. Carter

(57) ABSTRACT

Systems and methods for registering a cover with respect to a text body to create bound documents with floating and attached spines are described. In one embodiment, a text body having a front end, two opposed side ends, and a spine end that is located opposite to the front end is formed from two or more sheets, and a single-piece cover is registered with respect to at least one end of the text body.

27 Claims, 5 Drawing Sheets

SYSTEMS AND METHODS OF REGISTERING A COVER WITH RESPECT TO A TEXT BODY

CROSS-REFERENCE TO RELATED APPLICATIONS

Under 35 U.S.C. § 120 this application claims the benefit of co-pending U.S. patent application Ser. No. 09/721,549, filed Nov. 24, 2000, by Robert L. Cobene et al., and entitled "SYSTEMS AND METHODS OF ATTACHING A COVER TO A TEXT BODY," which is incorporated herein by reference.

This application also relates to co-pending U.S. patent application Ser. No. 09/728,003 filed Dec. 1, 2000, by Robert L. Cobene et al., and entitled "SYSTEMS AND METHODS OF INCREASING BINDING STRENGTH OF A BOUND TEXT BODY," and to co-pending U.S. patent application Ser. No. 09/726,251 filed Feb. 3, 2001, by Robert L. Cobene et al., and entitled "SYSTEMS AND METHODS OF BINDING A TEXT BODY," both of which are incorporated herein by reference.

TECHNICAL FIELD

This invention relates to systems and methods of registering a cover with respect to a text body.

BACKGROUND

Today, a variety of different bookbinding systems can deliver professionally bound documents, including books, manuals, publications, annual reports, newsletters, business plans, and brochures. A bookbinding system generally may be classified as a commercial (or trade) bookbinding system that is designed for in-line manufacturing of high quality volume runs or an in-house (or office) bookbinding system designed for short "on-demand" runs. Commercial bookbinding systems generally provide a wide variety of binding capabilities, but require large production runs (e.g., on the order of thousands of bindings) to offset the set-up cost of each production run and to support the necessary investment in expensive in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets (or pages) into a text body (or book block) that includes a spine and two side hinge areas. The bookbinding system applies an adhesive to the text body spine to bind the sheets together. A cover may be attached to the bound text body by applying an adhesive to the side hinge areas or the spine of the text body, or both. The cover of a typical commercial soft cover book generally is attached to the text spine. The covers of hardcover books and some soft cover "lay flat" books, on the other hand, typically are not attached to the text body spines (i.e., the spines are "floating").

Many different systems have been proposed for making books with attached spines. For example, U.S. Pat. No. 5,346,350 discloses an apparatus for binding sheets that includes a pair of clamping plates that hold the sheets during binding after an aligning plate has aligned the sheet edges. A heating platen heats and melts a backless solid hot melt adhesive that is placed along the sheet edges. The hot melt adhesive binds the sheets together at the spinal area. The hot melt adhesive also may be used to attach a preformed book cover to the text body spine.

International Patent Publication No. WO 99/38707 discloses a paperback bookbinding scheme in which a cover with an adhesive strip disposed along a spine area is forced between a pair of pressing rollers to form a pocket, and a text body is inserted into the pocket with the text body spine in contact with the adhesive strip. The pressing rollers are moved forcibly toward one another to compress the cover firmly against the front and back sides of the text body and to compress the text body sheets together tightly in the area adjacent to the spine. A sonic tool transmits sonic energy to the cover to activate the adhesive strip and, thereby, bind the text body sheets and the cover into a perfectly bound book.

Similarly, many different systems have been proposed for making books with floating spines.

For example, U.S. Pat. No. 5,779,423 discloses a paperback bookbinding scheme in which the text body is bound by a hot melt adhesive that is attached to a coating (or laminating) film that prevents the text body from attaching to the cover in the spinal area of the cover. In this way, the book is free to open with a floating spine. In one embodiment, a molten synthetic resin of pressure-sensitive glue (or adhesive) is applied to the spine and side hinge areas of the text body. A non-adhering coating is applied to a region of the cover that extends over the spinal area between a pair of hinge score lines. The non-adhering coating is formed from a quick-drying liquid carrier and a powdered material. Glue strips are applied to the cover along lines just beyond the score lines. The text body is attached to the cover by the glue strips and is attached to the non-adhering coating by the pressure sensitive adhesive. When the book is opened, the non-adhering coating allows the text body to move independently of the spinal portion of the cover. In another embodiment, a clear plastic film is laminated to the side hinge areas of the cover, but is unattached to the cover in the spinal area where a non-adhering coating previously was applied. The text body is attached to the laminating film by hot melt glue strips. As a result, when the book is opened, the text body is free to move independently of is the spinal area of the cover.

U.S. Pat. No. 5,261,769 discloses a paperback bookbinding scheme in which the text body is bound by an adhesive. A crash layer (or crinkle paper layer) is attached by a glue adhesive to one or both side hinge areas of the cover, but not to the spinal area of the cover. The crash layer then is attached to the text body by a glue adhesive. Thus, the cover is not attached to the crash layer, allowing the book to open with a floating spine.

U.S. Pat. No. 4,299,410 discloses a paperback bookbinding scheme in which the text body is bound by a flexible support layer (e.g., gauze, cloth, crepe strip or ribbon). The cover is attached to the text body by two adhesive glue strips that extend along the front and back hinge areas.

Japanese Patent Publication No. 8324153 discloses a bookbinding scheme in which a tape is laminated to the front and rear of a text body, but not to the spine area of the text body. The entire extent of the tape is bonded to the cover. When the book is opened, the text body is allowed to move independently of the tape in the area of the book spine.

Japanese Patent Publication No. 6048065 discloses a bookbinding scheme in which a hot melt adhesive is applied to the spine and side hinge areas of a text body. A "paste-dissolving liquid" is applied to the spinal area to prevent the text body from adhering to the cover. As a result, when the cover is pressed against the text body, the cover attaches only to the side hinge areas of the text body.

Still other bookbinding systems have been proposed.

SUMMARY

The invention features novel systems and methods for registering a cover with respect to a text body to create bound documents with floating and attached spines.

In one aspect, the invention features a bookbinding scheme in accordance with which a text body having a front end, two opposed side ends, and a spine end that is located opposite to the front end is formed from two or more sheets, and a single-piece cover is registered with respect to at least one end of the text body.

Embodiments in accordance with this aspect of the invention may include one or more of the following features.

The single-piece cover preferably is registered with respect to two ends of the text body. For example, the single-piece cover may be registered with respect to the front end and one of the two side ends of the text body.

The text body preferably is formed by registering the sheets with respect to two datum edges so that variations in sheet width dimension are accommodated in the spine end of the text body. For example, the two datum edges may be positioned to contact the front end and one of the two opposed side ends of the text body, respectively.

A portion of the single-piece cover preferably is folded over the text body. Excess material preferably is trimmed from the folded portion of the single-piece cover. The folded portion of the single-piece cover may be trimmed along a line corresponding to the front end of the text body. The single-piece cover preferably is registered with respect to the front end of the text body to determine the line along which the single-piece cover is trimmed.

The single-piece cover preferably is attached to two side hinge areas bounding the spine end of the text body.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
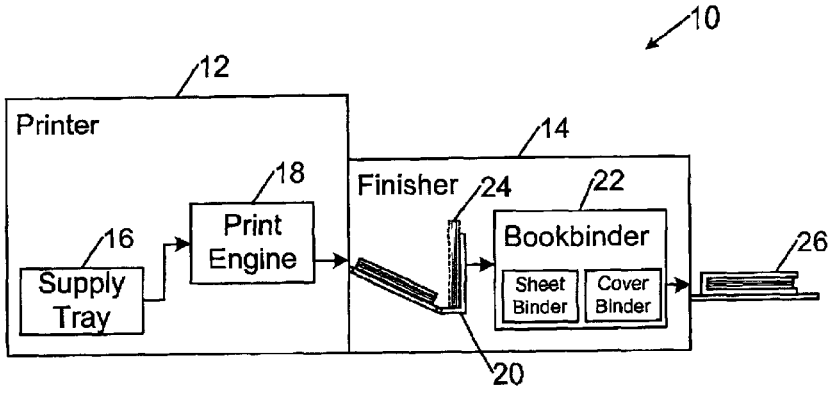
FIG. 1 is a diagrammatic side view of a bookbinding system.

Referring to FIG. 1, in one embodiment, a bookbinding system 10 includes a printer 12 and a finisher 14. Bookbinding system 10 may be implemented as a desktop or office bookmaking system designed to satisfy on-demand bookbinding needs. Printer 12 may be a conventional printer (e.g., a LaserJet® printer available from Hewlett-Packard Company of Palo Alto, Calif., U.S.A.) that includes a supply tray 16 that is configured to hold a plurality of sheets (e.g., paper sheets), and a print engine 18 that is configured to apply markings onto the sheets received from supply tray 16. Finisher 14 includes a sheet collector 20 and a bookbinder 22. Bookbinder 22 includes a sheet binder that is configured to bind the text body sheets to one another, and a cover binder that is configured to attach a cover to the bound text body. In operation, sheets are fed from supply tray 16 to print engine 18, which prints text, pictures, graphics, images and other patterns onto the sheets. The printed sheets are fed to sheet collector 20, which collects and aligns the sheets into a text body 24 with an exposed spine bounded by two exposed side hinge areas. The text body 24 is conveyed to bookbinder 22. The sheet binder binds the sheets of text body 24, and the cover binder attaches a cover to the bound text body to produce a bound book 26 with a floating or attached spine.

Figure 2A:
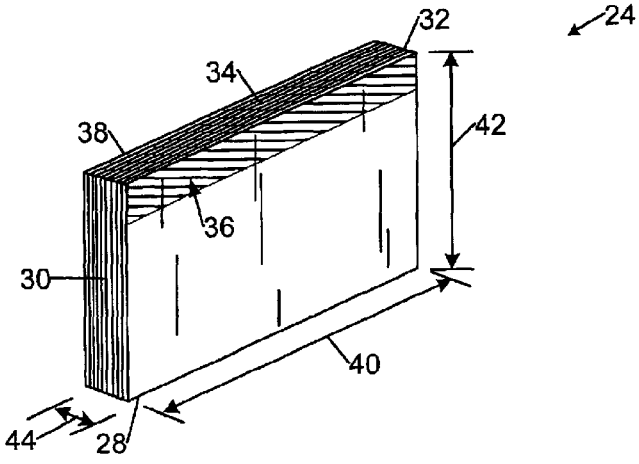
FIG. 2A is a diagrammatic perspective view of a text body formed by collecting and aligning a plurality of sheets.
Figure 2B:
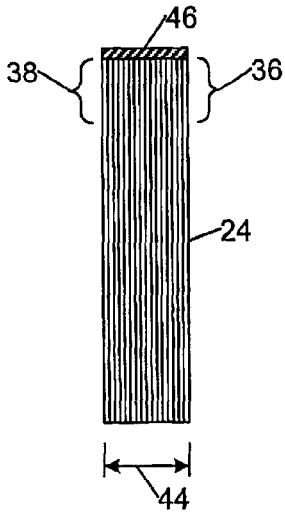
FIG. 2B is a diagrammatic end view of the text body of FIG. 2A bound by a hot melt adhesive applied to the text body spine.

As shown in FIGS. 2A and 2B, text body 24 includes a plurality of sheets and is characterized by a front end 28, two sides 30, 32 and a spinal area (or spine) 34, which is located opposite to front end 28. Spine 34 is bounded by two side hinge areas 36, 38. Text body 24 may be characterized by a height dimension 40, a width dimension 42, and a thickness dimension 44. In one embodiment, height dimension 40 and thickness dimension 44 are measured or gauged. A hot melt adhesive 46 is pre-formed, applied to the text body spine 34, and heated to a temperature at or above the melting temperature of the adhesive. The melted adhesive conforms to the exposed surface features of spinal area 34 and flows into spaces between the edges of the sheets by capillary action. Upon cooling, hot melt adhesive 46 re-solidifies and binds the sheets into a bound text body. A variety of different hot melt adhesive compositions may be used to bind the text body sheets, including a conventional paper-backed hot melt sheet adhesive that may be dispensed from a roll.

Figure 3A:
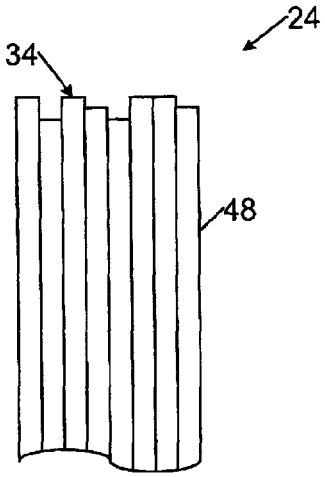
FIG. 3A is a diagrammatic end view of a text body formed by registering sheets with respect to two datum edges so that variations in sheet width dimension are accommodated in the spine end of the text body.
Figure 3B:
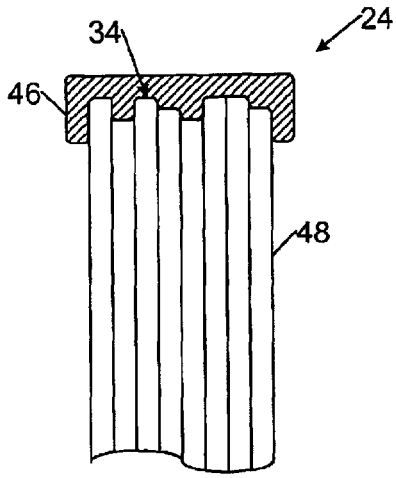
FIG. 3B is a diagrammatic end view of the text body of FIG. 3A bound by a hot melt adhesive that is applied to the text body spine.

Referring to FIGS. 3A and 3B, in one embodiment, the spinal area exposed for adhesive penetration may be increased before adhesive is applied by registering and aligning text body sheets 48 with respect to two datum edges. In particular, the sheets preferably are jogged, vibrated and aligned with reference to front end 28 of text body 24 and one of the two text body sides 30, 32 so that variations in sheet dimensions are accommodated in the text body width dimension 42 of spinal area 34. As a result, the spinal surface area exposed for adhesive penetration is greater than if all of the sheets 48 were registered and aligned with respect to spine edge 34. As shown in FIG. 3B, after pre-formed hot melt adhesive 46 is applied to the text body spine 34 and heated to a temperature at or above the melting temperature of the adhesive, the melted adhesive conforms to the exposed surface features of spinal area 34 and flows into spaces between the ends of sheets 48. Upon cooling, hot melt adhesive 46 re-solidifies and binds the sheets 48 into a bound text body. The resulting bonds between text body sheets 48 are greater than bonds between sheets registered and aligned at spine edge 34.

Further details regarding methods of increasing the binding strength of text body 24 may be found in co-pending U.S. patent application Ser. No. 09/728,003 filed Dec. 1, 2000, by Robert L. Cobene et al., and entitled "SYSTEMS AND METHODS OF INCREASING BINDING STRENGTH OF A BOUND TEXT BODY," which is incorporated herein by reference.

A cover is attached to the bound text body to form a perfectly bound book that may have an attached spine or a floating spine. As explained in detail below, the front of the cover is aligned precisely with the front face of text body 24 so that the cover is lined up properly with the opening edge of the resulting perfectly bound book.

Figure 4:
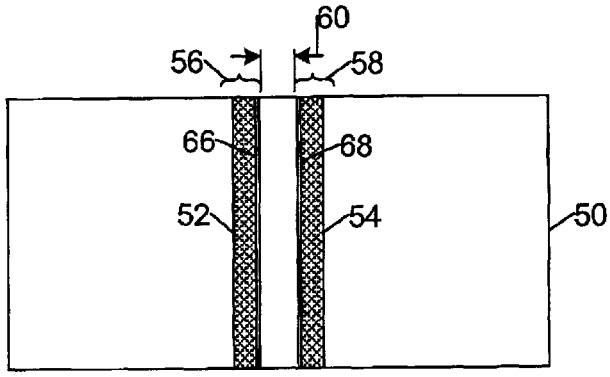
FIG. 4 is a diagrammatic front view of a cover with two strips of pressure sensitive adhesive that are applied to areas corresponding to the side hinge areas of the text body of FIGS. 3A and 3B.

Referring to FIG. 4, in one embodiment, a solid pressure sensitive adhesive film is used to attach a cover 50 to text body 24. The solid pressure sensitive adhesive film is applied to cover 50 as two strips 52, 54 in cover areas 56, 58 that correspond to side hinge areas 36, 38 of text body 24. Pressure sensitive adhesive strips 52, 54 are spaced apart by a width dimension 60 that is at least as wide as the thickness dimension 44 of text body spine 34. As used herein, "pressure sensitive adhesives" refer to a class of adhesive compositions that are applied with pressure and generally do not undergo a liquid to solid transition in order to hold materials together. Pressure sensitive adhesives may be solvent-free natural or synthetic resins characterized by the rapid wetting of a surface to form an adhesive bond upon contact with the surface under pressure.

Figure 5A:
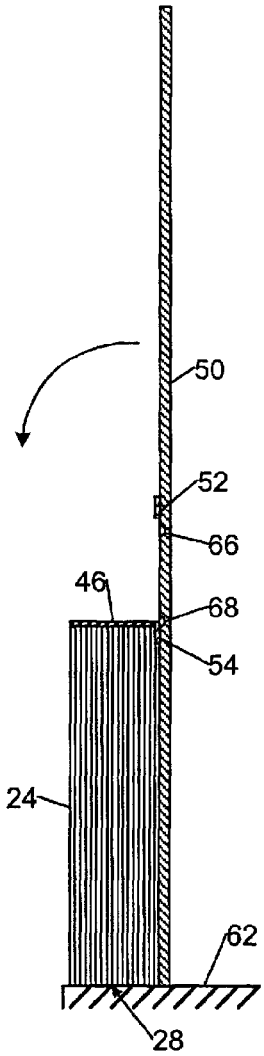
FIG. 5A is a diagrammatic end view of the cover of FIG. 4 that is positioned adjacent to the bound text body of FIG. 3B and registered with respect to two datum edges.
Figure 5B:
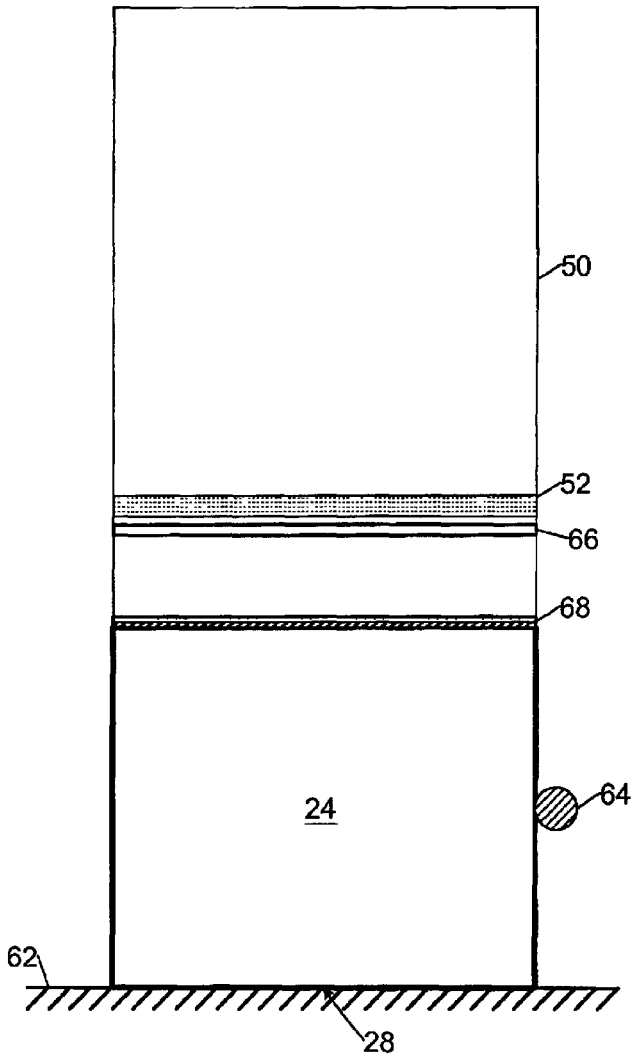
FIG. 5B is a diagrammatic front view of the cover and the bound text body of FIG. 5A.

As shown in FIGS. 5A and 5B, cover 50 is formed from a single piece of cover stock with a width dimension that matches height dimension 40 of text body 24 and a length dimension that is sufficiently long to cover the entirety of text body 24. The length of the cover stock may be pre-trimmed or it may be trimmed after the cover is attached to the text body. The cover is positioned adjacent to the front face of text body 24 and registered with respect to two datum edges 62, 64 that are positioned to contact the same text body ends used to align sheets 48. In one embodiment, cover 50 is registered with respect to front end 28 and the side end 30, 32 that was used to align sheets 48. In operation, after being aligned with the front datum edge 62, cover 50 is jogged until it contacts side datum edge 64.

Figure 6:
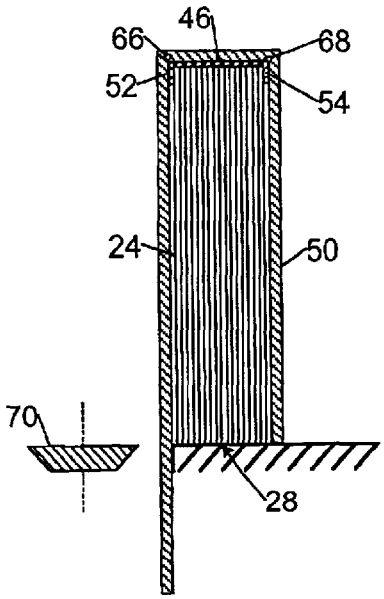
FIG. 6 is a diagrammatic end view of a bound book formed by folding the cover of FIG. 4 over the bound text body of FIG. 3B.

Referring to FIG. 6, after registration, a portion of cover 50 is folded over text body 24 to form a perfectly bound book. Cover 50 preferably is scored along a pair of score lines 66, 68 to allow cover 50 preferentially to fold over spinal area 34 of text body 24. Exact alignment of the cover front edge with the text body front edge, as shown in FIG. 5A and 5B, allows the locations of score lines 66 and 68 to have lower accuracy in position and still yield an exact cosmetic alignment after the cover is folded over the text body. In other words, by aligning the front edge of the cover s with the front edge of the text body, a high quality perfect bound book may be produced even though the locations of score lines 66, 68 may be slightly offset from the ideal score line locations. This feature improves the robustness of the bookbinding process. After being folded over text body 24, cover 50 is clamped in position against text body 50. Pressure is applied to cover areas 56, 58 to activate pressure sensitive adhesive strips 52, 54 and, thereby, attach cover 50 to text body 24. Excess material that protrudes along the back face of text body 24 may be trimmed from the folded portion of cover 50 by a cutter wheel 70 that is configured to trim cover 50 along a line that corresponds to the edge of front end 28 of text body 24. The back edge of text body 24 may be used to adjust and guide cutter wheel 70.

Figure 7A:
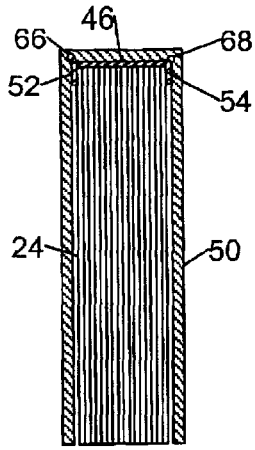
FIG. 7A is a diagrammatic end view of the bound book of FIG. 6 with the folded portion of the cover trimmed along a line corresponding to the front end of the text body.
Figure 7B:
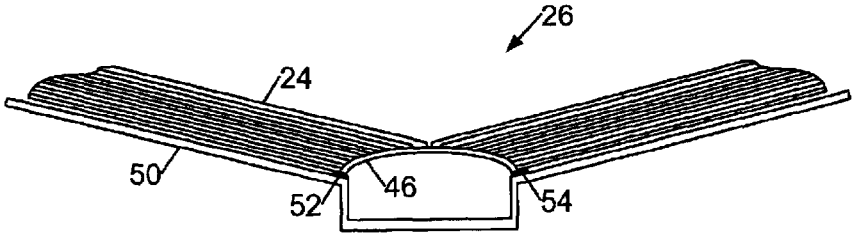
FIG. 7B is a diagrammatic end view of the bound book of FIG. 6 opened with a floating spine.

As shown in FIGS. 7A and 7B, the resulting perfectly bound book 26 has a floating spine that enables the book 26 to lay flat when opened.

Other embodiments are within the scope of the claims.

Figure 8:
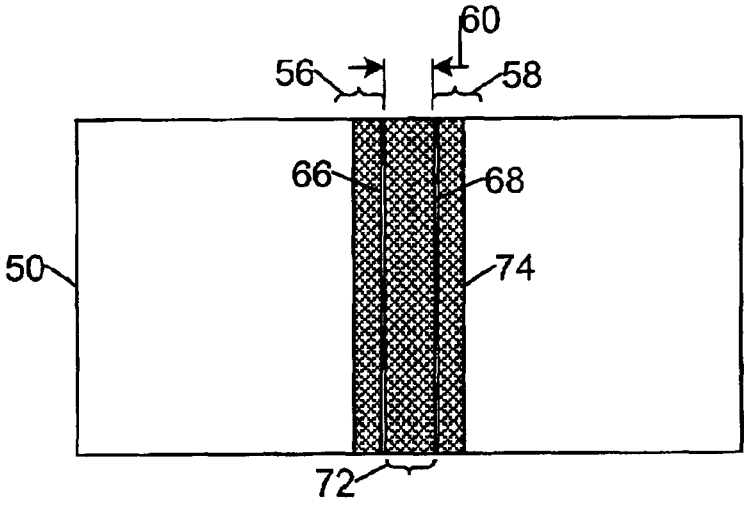
FIG. 8 is a diagrammatic front view of a cover with a single strip of pressure sensitive adhesive applied to an area corresponding to the spine and side hinge areas of the text body of FIGS. 3A and 3B.
Figure 9:
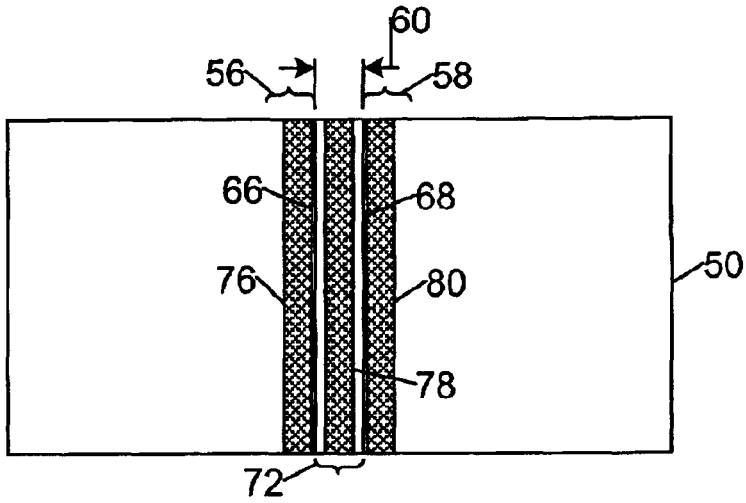
FIG. 9 is a diagrammatic front view of a cover with multiple strips of pressure sensitive adhesive applied to an area corresponding to the spine and side hinge areas of the text body of FIGS. 3A and 3B.

For example, as shown in FIGS. 8 and 9, text body 24 may be bound to cover 48 with an attached spine construction by applying a solid pressure sensitive adhesive film to a cover area 72 that corresponds to text body spine 34. The solid pressure sensitive adhesive film may be applied as a single continuous strip 74 over cover areas 56, 58, and 72 (FIG. 8), or in a series of multiple strips 76, 78, 80 over cover areas 56, 58, and 72 (FIG. 9).

Further details regarding alternative methods of attaching cover 50 to text body 24 may be found in co-pending U.S. patent application Ser. No. 09/721,549, filed Nov. 24, 2000, by Robert L. Cobene et al., and entitled "SYSTEMS AND METHODS OF ATTACHING A COVER TO A TEXT BODY," which is incorporated herein by reference.

In some embodiments, the same sheet adhesive may be used both to bind the text body sheets and to bind the cover to the text body to produce bound books with floating and attached spines.

Still other embodiments are within the scope of the claims.

What is claimed is:

1. A bookbinding method, comprising:

forming from two or more sheets a text body having a front end, two opposed side ends, a spine end located opposite to the front end, and first and second faces corresponding to substantially planar outward facing surfaces of first and second sheets located at opposite sides of the text body, the outward facing surfaces being exposed for contact with a cover;

registering a single-piece cover with respect to at least one end of the text body by abutting a front edge of the single-piece cover and the front end of the text body against a mutual datum edge, wherein the single-piece cover is positioned in registered abutment against the first face of the text body; and sequentially folding the abutting single-piece cover into contact with the spine end and then the second face of the text body.

2. The bookbinding method of claim 1, wherein two edges of the single-piece cover are respectively registered flush with respect to two ends of the text body before the single-piece cover is folded.

3. The bookbinding method of claim 2, wherein two edges of the single-piece cover are respectively registered flush with respect to the front end and one of the two side ends of the text body before the single-piece cover is folded.

4. The bookbinding method of claim 1, wherein the text body is formed by registering the sheets with respect to two datum edges so that variations in sheet width dimension are accommodated in the spine end of the text body.

5. The book binding method of claim 4, wherein the single-piece cover is registered with respect to the front end and one of the two side ends of the text body.

6. The bookbinding method of claim 1, further comprising attaching the single-piece cover to two side hinge areas bounding the spine end of the text body.

7. The bookbinding method of claim 1, further comprising applying solid pressure sensitive adhesive to cover areas corresponding to side hinge areas of the text body before registering the single-piece cover.

8. The bookbinding method of claim 1, wherein the text body is formed by registering the sheets with respect to a datum edge contacting the front end and a datum edge contacting one of the two opposed side ends, and the single-piece cover is registered with respect to the same two datum edges.

9. A bookbinding method, comprising:

forming from two or more sheets a text body having a front end, two opposed side ends, and a spine end located opposite to the front end, wherein the text body is formed by registering the sheets with respect to two datum edges so that variations in sheet width dimension are accommodated in the spine end of the text body, wherein the two datum edges are positioned to contact the front end and one of the two opposed side ends of the text body, respectively; and registering a single-piece cover with respect to at least one end of the text body.

10. The bookbinding method of claim 9, further comprising applying solid pressure sensitive adhesive to cover areas corresponding to side hinge areas of the text body before registering the single-piece cover.

11. The bookbinding method of claim 9, wherein the single-piece covered is registered with respect to the same two datum edges.

12. A bookbinding method, comprising:

forming from two or more sheets a text body having a front end, two opposed side ends, a spine end located opposite to the front end, and first and second faces corresponding to substantially planar outward facing surfaces of first and second sheets located at opposite sides of the text body, the outward facing surfaces being exposed for contact with a cover;

registering a single-piece cover with respect to at least one end of the text body, wherein the single-piece cover is positioned in registered abutment against the first face of the text body;

sequentially folding the abutting single-piece cover into contact with the spine end and then the second face of the text body; and trimming excess material from the folded portion of the single-piece cover.

13. The bookbinding method of claim 12, wherein the folded portion of the single-piece cover is trimmed along a line corresponding to the front end of the text body.

14. The bookbinding method of claim 13, further comprising registering the single-piece cover with respect to the front end of the text body to determine the line along which the single-piece cover is trimmed.

15. A bookbinding system, comprising:

a sheet binder configured to form from two or more sheets a text body having a front end, two opposed side ends, a spine end located opposite to the front end, and first and second faces corresponding to substantially planar outward facing surfaces of first and second sheets located at opposite sides of the text body, the outward facing surfaces being exposed for contact with a cover; and a cover binder configured to register a single-piece cover with respect to at least one end of the text body, wherein the single-piece cover is positioned in registered abutment against the first face of the text body and a front edge of the single-piece cover and the front end of the text body are abutted against a mutual datum edge, the cover binder being further configured to sequentially fold the abutting single-piece cover into contact with the spine end and then the second face of the text body.

16. The bookbinding system of claim 15, wherein the cover binder is configured to respectively register two edges of the single-piece cover flush with respect to two ends of the text body before the single-piece cover is folded.

17. The bookbinding system of claim 16, wherein the cover binder is configured to respectively register two edges of the single-piece cover flush with respect to the front end and one of the two side ends of the text body before the single-piece cover is folded.

18. The bookbinding system of claim 15, wherein the sheet binder is configured to form the text body by registering the sheets with respect to two datum edges so that variations in sheet width dimension are accommodated in the spine end of the text body.

19. The book binding system of claim 18, wherein the cover binder is configured to register the single-piece cover with respect to the front end and one of the two side ends of the text body.

20. The bookbinding system of claim 15, wherein the cover binder is configured to attach the single-piece cover to two side hinge areas bounding the spine end of the text body.

21. The bookbinding system of claim 15, wherein the cover binder is operable to apply solid pressure sensitive adhesive to cover areas corresponding to side hinge areas of the text body before registering the single-piece cover.

22. The bookbinding system of claim 15, wherein the sheet binder is operable to form the text body by registering the sheets with respect to a datum edge contacting the front end and a datum edge contacting one of the two opposed side ends, and the cover binder is operable to register the single-piece cover with respect to the same two datum edges.

23. A bookbinding system, comprising:

a sheet binder configured to form from two or more sheets a text body having a front end, two opposed side ends, and a spine end located opposite to the front end, wherein the sheet binder is configured to form the text body by registering the sheets with respect to two datum edges so that variations in sheet width dimension are accommodated in the spine end of the text body, wherein the two datum edges are positioned respectively to contact the front end and one of the two opposed side ends of the text body; and a cover binder configured to register a single-piece cover with respect to at least one end of the text body.

24. The bookbinding system of claim 23, wherein the cover binder is operable to apply solid pressure sensitive adhesive to cover areas corresponding to side hinge areas of the text body before registering the single-piece cover.

25. The bookbinding system of claim 23, wherein the cover binder is operable to register the single-piece cover with respect to the same two datum edges.

26. A bookbinding system, comprising:

a sheet binder configured to form from two or more sheets a text body having a front end, two opposed side ends, a spine end located opposite to the front end, and first and second faces corresponding to substantially planar outward facing surfaces of first and second sheets located at opposite sides of the text body, the outward facing surfaces being exposed for contact with a cover; and a cover binder configured to register a single-piece cover with respect to at least one end of the text body, wherein the single-piece cover is positioned in registered abutment against the first face of the text body, and to sequentially fold the abutting single-piece cover into contact with the spine end and then the second face of the text body, wherein the cover binder is configured to trim excess material from the folded portion of the single-piece cover.

27. The bookbinding system of claim 26, wherein the cover binder is configured to trim the folded portion of the single-piece cover along a line corresponding to the front end of the text body.

* * * * *